United States Patent [19]

Rusnak

[11] 4,254,956

[45] Mar. 10, 1981

[54] GOLF SWING TRAINING APPARATUS

[76] Inventor: Thomas L. Rusnak, 349 Toftrees Ave., Apt. 210, State College, Pa. 16801

[21] Appl. No.: 962,757

[22] Filed: Nov. 21, 1978

[51] Int. Cl.[3] ..... A63B 69/36

[52] U.S. Cl. ..... 273/186 R; 273/181 H

[58] Field of Search ..... 273/186 R, 186 RA, 181 H; 35/29 A

[56] References Cited

U.S. PATENT DOCUMENTS

| | | | |
|---|---|---|---|
| 2,571,974 | 10/1951 | Walker | 273/186 R |
| 2,825,569 | 3/1958 | Alvarez | 273/186 R |
| 3,020,049 | 2/1962 | McNeill | 273/186 R |
| 3,194,563 | 7/1965 | Mackniesh | 273/186 R |
| 3,601,408 | 8/1971 | Wright | 273/186 R |
| 3,992,013 | 11/1976 | Golden | 273/186 D |
| 4,146,230 | 3/1979 | Foster | 273/186 R |
| 4,155,555 | 5/1979 | Fink | 273/186 R |

*Primary Examiner*—George J. Marlo

*Attorney, Agent, or Firm*—Carothers and Carothers

[57] ABSTRACT

The time and position of a golf club head are sensed photoelectrically at selected stations along a practice swing, and corresponding characteristics of the swing and the resulting ball flight are computed electronically and displayed to the player. The lateral club position is sensed accurately by continuous strip sensors at spaced stations near the ball for computation of the swing direction. All light received by the strip sensors is respectively focused to light diffusing surfaces from which sensors read the amount of light focused thereon. The club head attitude at impact is determined by three triangularly spaced sensors spaced along the club face. The club head height at impact is determined by two directional-sensitive sensors spaced longitudinally with the club head path and having their paths of directional sensitivity crossing in the longitudinal direction. A plurality of these height detectors are also utilized to determine whether the club head is descending or rising at the time of impact. Club head velocity is also detected and all of these club head characteristics of swing are computed electronically into ball flight characteristics which are displayed. The electronic computing circuitry is not activated until a predetermined club head velocity is detected thereby eliminating erroneous readings of preliminary club head swings when addressing the ball.

7 Claims, 14 Drawing Figures

GOLF SWING TRAINING APPARATUS

BACKGROUND OF THE INVENTION

1. Field of the Invention

This invention relates generally to practice golf devices for detecting and indicating automatically the quality of individual golf swings.

More particularly, the present invention relates to electronic devices for measuring certain selected characteristics of a golf swing, for deriving from the resulting electrical signals information as to the ball flight that would normally result, for computing one or more overall evaluations of the swing, and for displaying the resulting data to the player.

The invention utilizes a captive or simulated ball, and obtains all the necessary information by sensing the movement of the club head. Movement of the club head during a practice swing is measured by a distinct group of sensors, typically comprising photosensors or phototransistors which respond to the shadow of the club head formed by a single light source. Although the sensors of each group are suitably arranged to measure a particular feature of the swing or to perform a specific function, the output from each group is typically employed in the computation of one or more than one basis for swing evaluation.

2. Discussion of the Prior Art

Golf swing practice devices of the type described in the field of invention are not new and the practice device of the present invention typically performs some of its functions in a conventional manner. However, other features of detection and operation are completely new, or utilize new principles of operation. With regard to the prior art, one golf swing analyzor employs light beams and photosensors for measuring club movement, but with only a one-to-one display of the light beams that are intercepted. This prior art device also includes a signal sensor for supplying plate voltage to some of its vacuum tubes in response to the back swing of the club, thereby "arming" the system. However, accidental arming may possibly occur when the player merely intends to address the ball with preliminary pre-swing club movements or "waggles".

In addition, some prior art device sense lateral position of the swinging club head by means of two spaced rows of sensors positioned laterally of the club head swing path and thus accurate lateral club head positions cannot be detected due to the interrupted spacing of sensors.

Furthermore, most prior art devices do not provide structure for detecting club head height or other vertical characteristics of club head movement.

Other prior art patents of interest are U.S. Pat. No. 2,825,569 issued to Luis W. Alvarez and U.S. Pat. No. 3,194,563 issued to Frank MacKniesh.

It is a principal object of the present invention to eliminate the aforementioned disadvantages of the prior art golf practice devices and to provide a golf practice device which is simpler in construction and more accurate in its sensing capabilities.

SUMMARY OF THE INVENTION

One advantage of the golf practice apparatus of the present invention is that it provides three sensors, instead of two, positioned in triangular configuration for developing signals in response to the passage of the club head leading edge at about the point of impact with the ball. The three sensors are responsive to laterally spaced points of the leading edge of the club head. Electronic circuitry receives the signals and is responsive to the mutual time relations in which the signals from two of the sensors are received relative to the third sensor and in that manner activates a display representing angular relation of the club head leading edge or face with respect to the normal club head path. The aforesaid two sensors are preferably aligned laterally of the club head path and the third sensor is spaced out of alignment with these two sensors. This sensing arrangement automatically compensates for varying velocities of the club head thereby providing accurate indications of club head face angle at the time of ball impact.

Another feature and advantage of the present invention is that lateral club head position of the swinging club head is sensed by an underlying continuous strip sensor which is positioned laterally of the club head path for developing a signal proportional to the portion of length thereof passed over by a swinging club head. These novel continuous strip sensors eliminate the disadvantages of the prior art wherein rows of separated sensors are employed, thereby providing more accurate lateral position reading.

This continuous strip sensor is also novel in and of itself and comprises a light receiving strip and means to focus light received from the entire continuous strip to a single light sensitive sensor such as a phototransistor. This means to focus the light from the light receiving strip includes a light diffuser which is positioned to receive light focused from the strip as by a lens, mirror or prism, and the light sensitive sensor or phototransistor is positioned in turn to sense light from this diffuser, thereby eliminating the requirement of accurate focusing of the light from the relatively large continuous light receiving strip directly on the very small light sensor.

Two of these continuous strip light sensor mechanisms are generally employed for representing the lateral position of the swinging club head and the light receiving strips of the respective mechanism are relatively spaced longitudinally of the club head path. Electronic circuitry is then employed and responsive to the output signals of both of these mechanisms to produce a final signal that represents the direction of lateral movement of the club head between the light receiving strips of the respective mechanism.

Another novel feature and advantage of the golf practice apparatus of the present invention is that it has the capabilities of sensing the height position of the swinging club head. The present invention provides two alternative methods or devices for so detecting the club head height at or about impact with the ball. The preferred apparatus for sensing club head height uniquely senses the club height with the use of sensors positioned underneath the club head swing path. The alternative novel sensor device for detecting club head height utilizes a detector for sensing vertical shadows of the club head as opposed to shadows cast below the club head.

The preferred mechanism for representing the height position of the swinging club head utilizes two directional-sensitive sensors spaced longitudinally with the club head path and these sensors are positioned such that their paths of light sensing directional sensitivity cross each other in the longitudinal direction of the club head path. These sensors are responsive to the passage of the club head leading edge through their respective paths of light sensing directional sensitivity at respective longitudinally spaced points of the club head path. A time discriminating circuit receives the signal and is responsive to the mutual time relation in which the signals are received to produce an output signal proportional to the height of the club head within the normal path of direction. Since the light sensing paths of the two sensors cross each other, the time required for the club head leading edge to cut through both sensor paths is shorter when the club head is high than when the club head is low, as the sensor paths of detection converge toward each other in a vertical plane.

Two such height detecting mechanisms may be employed and relatively spaced longitudinally with respect to each other on the club head path, and in this situation, electronic circuitry is provided which is responsive to the output signal of both of these mechanisms to produce a final signal that represents the direction of vertical movement of the club head between the centers of the respective mechanisms. In this manner, it can be determined whether the club head is rising or descending in the vertical plane at the time of ball impact.

One means for providing velocity correction for this height detection circuit is the inclusion of a third sensor which is spaced from the aforementioned two sensors in the club head normal path, and then, as was the situation with face angle detection, time discriminating circuit means receives the output signals from all three sensors and is responsive to the mutual time relations in which the signals from the first two mentioned sensors are received relative to the third sensor to provide velocity correction.

A reset button and circuit is provided to de-activate the display of club head swing characteristics and in addition, a velocity limit detection circuit is provided which is responsive to a predetermined practice swing minimum velocity limit of the club head to activate the display of the club head swing characteristics. Thus, club head "waggles" sometimes made by golfers when first addressing the ball will not activate the device prematurely.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE PREFERRED EMBODIMENTS

Figure 1:
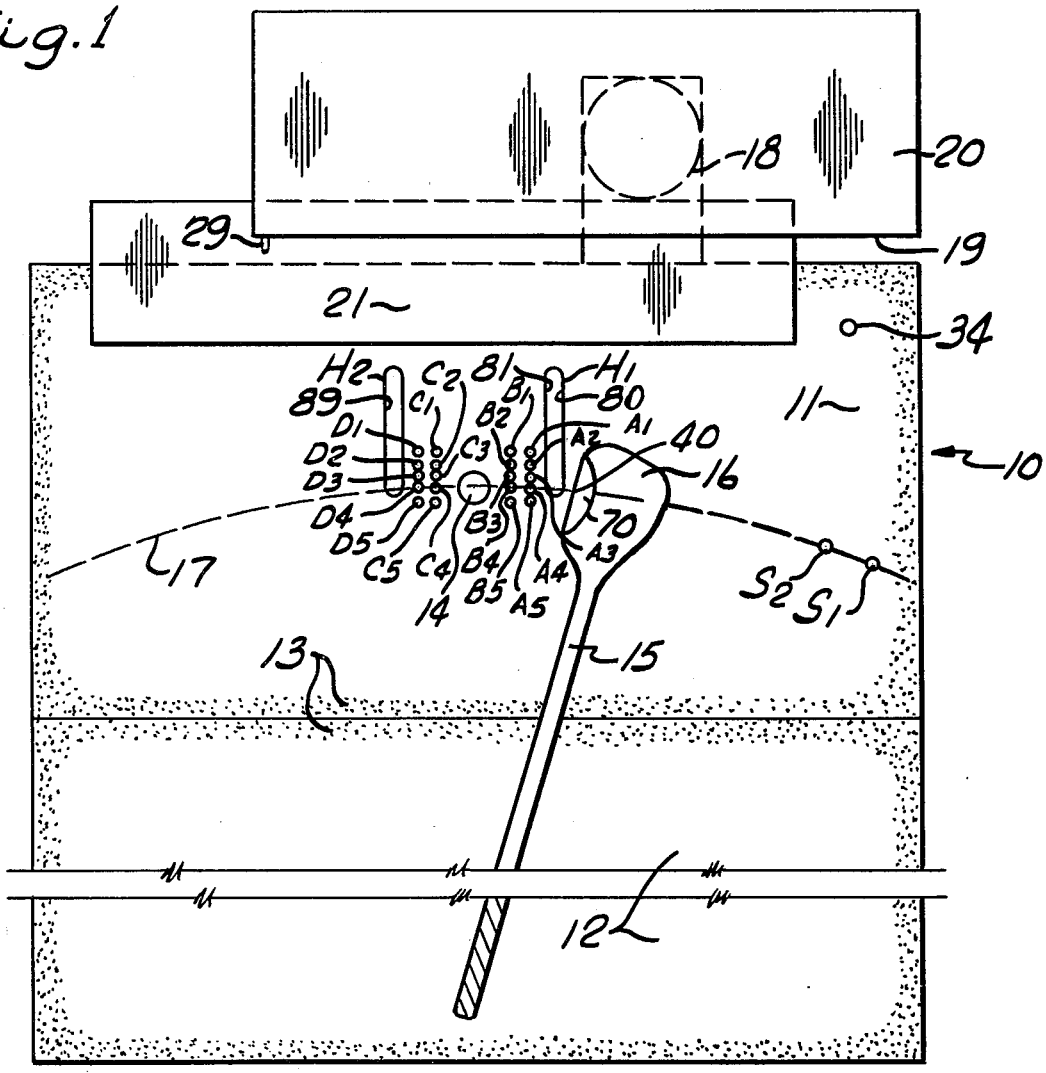
FIG. 1 is a somewhat schematic plan view representing an illustrative golf practice system in accordance with the present invention.
Figure 2:
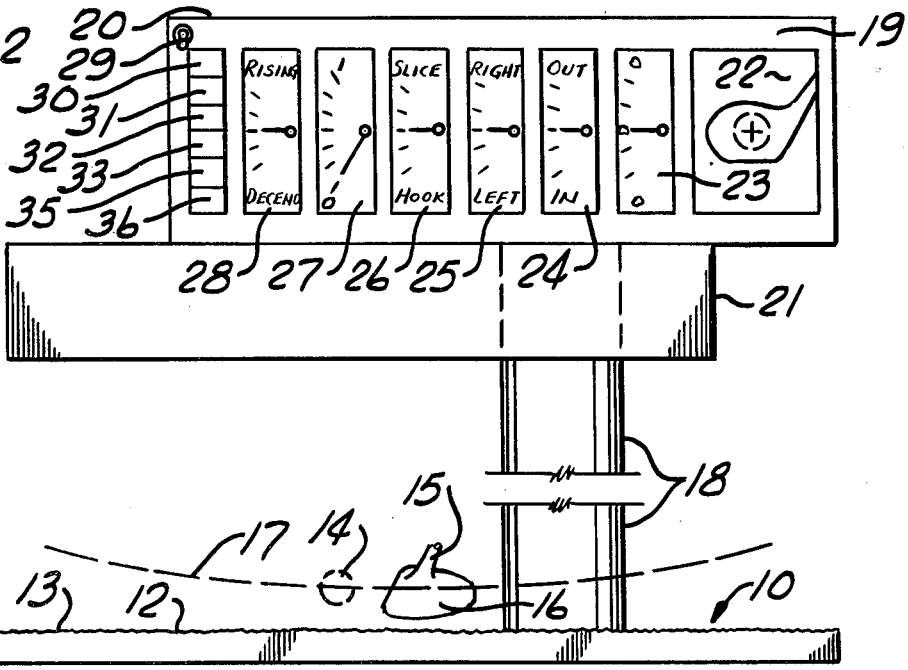
FIG. 2 is a somewhat schematic front view representing the display panel for ball flight characteristics in the apparatus of FIG. 1.

Referring first especially to FIGS. 1 and 2, the present illustrated practice device is mounted on a flat base 10. The forward portion of base 10 provides the playing surface 11 and a supplementary ground surface 12 is provided adjoining playing surface 11 for the player to stand on. Surface 12 is here constructed integrally with base 10, but may be provided separately. Both the playing surface 11 and the standing surface 12 are covered with an artificial grass 13.

Base 10 carries a suitable indication of an impact point or golf ball 13 which is here provided by a holographic image through the use of conventional lights, lenses and mirrors. However, any conventional form of captive or dummy ball may be utilized such as a captive ball mounted on a flexible resilient arm or a swing arm, such as for example, illustrated in the aforementioned examples of prior art. A conventional driver golf club 15 with a conventional club head 16 is also illustrated in suspension as though being swung by a player through a normal golf swing path as indicated by the dashed line 17 in order to impact with the ball image 14.

The main instrument frame also includes column 18 which is rigidly mounted to base 10 and is spaced far enough from the ball to be out of the way of the golf club head swing. Column 18 carries display panel 19 on which is displayed the various ball flight or club head swing characteristics. This panel forms the front face of housing 20 which houses some of the computing circuitry. Light shield 21 is attached to the bottom of housing 20 and houses electric lamps (not shown) therein for activating the light sensors embedded in and under playing surface 11. As will be seen hereinafter, common sunlight may also be used in substitution of these lamps, and use of this apparatus in bright sunlight does not effect its accurate results, as would be the case with the aforementioned devices of the prior art.

Figure 3:
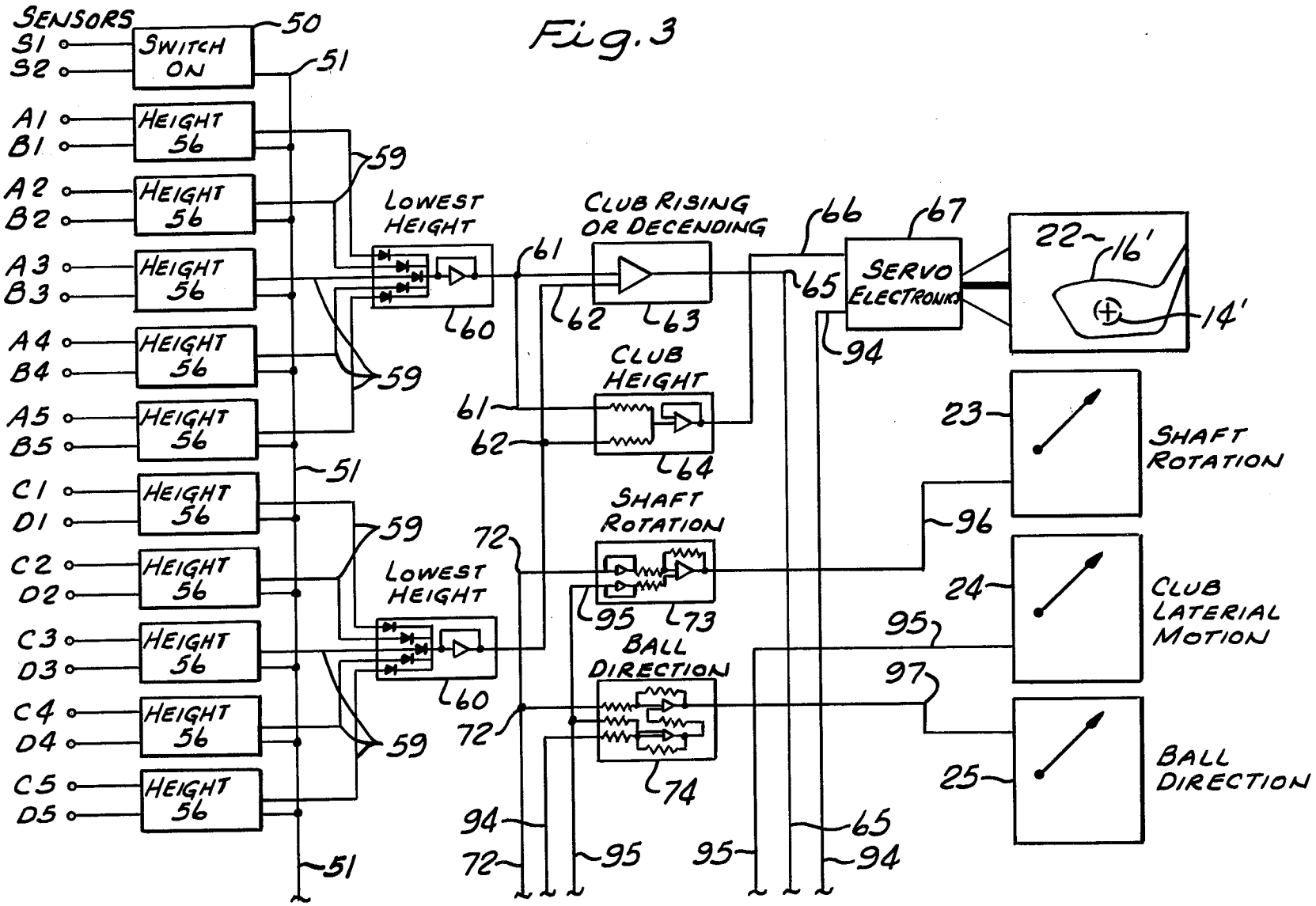
FIG. 3 is a schematic block diagram representing typical circuitry for deriving swing and flight data in the apparatus of FIG. 1.
Figure 3:
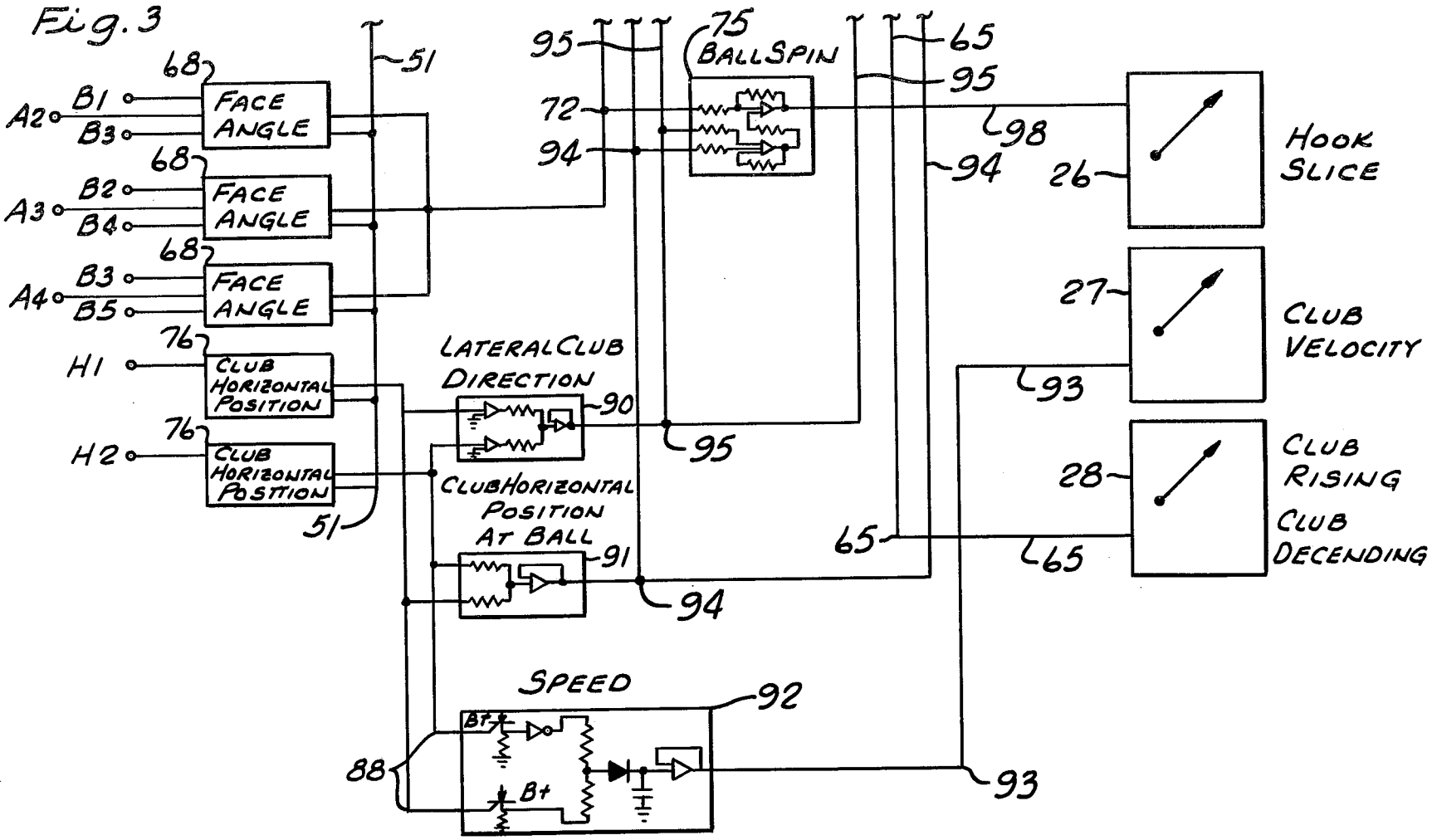

Display panel 19 has a number of individual meters and indicators thereon for indicating different golf club swing and golf ball flight characteristics. Referring specifically to FIGS. 2 and 3, meter 22 indicates the point of impact of the golf ball with the club head face. Meter 23 indicates golf club shaft rotation or golf club head face angle at impact with the ball. Meter 24 indicates golf club head lateral motion. Meter 25 indicates ball direction in flight and meter 26 indicates ball flight hook or slice and the degree of hook or slice. In this regard, all meters indicate the degree or magnitude of error.

Meter 27 indicates club head velocity or ball flight distance, and meter 28 indicates whether the club head is rising or descending at the time of impact with the ball. An off and on switch 29 is also provided on panel 19 for energizing the apparatus from a common electrical AC outlet.

Adjacent to switch 29 is provided a series of indication lamps. Lamp 30 indicates power is on by activation of switch 29, lamp 31 is provided to indicate that the device is reset and ready for detecting another practice golf swing, indicator lamp 32 is provided to indicate that a gross swing error has occurred, lamp 33 indicates that the display apparatus is on hold and that the apparatus must be reset by pressing reset button 34 as seen in FIG. 1 with the head of the golf club, and indicator lamps 35 and 36 merely indicate respectively that the display panel is lit with auxiliary lighting and that the lamps housed within light shield 21 are lit and not burned out.

Movement of the club head is detected by a plurality of photosensors which detect interruption of respective light beams that extend between selected points of base 10 and the light source within light shield 21 or common sunlight. In the preferred structure shown, the photosensors are mounted below the surface of base 10 and some of them are mounted in light shield tunnel for directional sensitivity. Referring to FIG. 1, the windows or apertures through the playing surface 11 are shown for the sensors.

Sensors S1 and S2 are switch on sensors which sense a minimum forward velocity of the golf club head to arm or activate all of the sensors and detection circuits. As the leading edge of the golf club head 16 passes along its normal path direction as indicated by dashed line 17, a time discriminating circuit discerns the elapsed time from when the leading edge breaks the light or overshadows sensor S1 to the time that it overshadows sensor S2 thereby giving an indication of velocity and the golf swing practice apparatus is not energized until this velocity is of sufficient value to indicate that a full swing of the golf club is being made and not just a "waggle" ball address swing. Thus, the device is activated on the forward full downswing instead of on the club backswing as is done with practice swing devices of the prior art.

The continuous strip or slot-like windows or apertures H1 and H2 are provided for the continuous strip sensors for sensing the lateral position of the swinging club head. These continuous strip sensors are positioned laterally of the club head path 17 for developing a signal proportional to the portion of length thereof which is passed over or overshadowed by the swinging club head 16. Output signals are then generated proportionately as a representation of the lateral position of the club head. The provision of two such sensors H1 and H2 as indicated permits relative lateral club head sensing to determine whether the club head 16 is on its normal path 17 or is improperly heading out or inward at impact with ball 14. The fact that sensor strips H1 and H2 are continuous, rather than being made up of rows of spaced independent sensors, permits the lateral sensing to be much more accurate than was heretofore possible with such lateral sensors of the prior art. These lateral club head position sensors are also utilized to detect velocity of the club head 16 at impact by measuring the time interval from when the leading edge of club head 16 passes over sensor H1 to the time that it subsequently passes over sensor H2.

The face angle of club head 16 in relation to normal path 17 at the time of impact of ball 14 is sensed by three sensors which are positioned in triangular configuration in front of or to the right of ball 14 as viewed in FIG. 1. In fact, several sets of triangularly positioned sensors are utilized in case the club head 16 deviates from normal path 17, and the first set of triangularly positioned sensors which is activated by passage of the leading edge of the club head 16 dominates determination of the club head face angle and detection of the other face angle circuits or sensors is ignored.

For example, the triangular configuration of sensors B3, A4 and B5 determines the face angle or angular relation of the club head leading edge with respect to the normal path 17 when club head 16 is properly and directly on directional path 17. This is illustrated in better detail in FIG. 8.

However, two other triangular sets of face angle sensors are also provided in the combination of sensors B2, A3, B4 as a second triangular set and in the combination of sensors B1, A2, B3 in the third triangular configuration of sensors.

The electronic circuitry receiving signals from any one of these three sets of sensors develops signals in response to the passage of the club head leading edge approximately at the point of impact of the ball as the sensors are responsive to laterally spaced points of the leading edge 40 of club head 16. A time discriminating circuit receives the signal and is responsive to the mutual time relations in which the signals from the leftmost two sensors (sensors B3 and B5 in FIG. 8) are received relative to the third or leading sensor (sensor A4 in FIG. 8). If the leading edge 40 of golf club head 16 engages or overshadows sensor A4 first, then the circuitry will ignore signals received from sensors A2 or A3. To the contrary, if the leading edge engages sensor A2 or A3 first, then signals received from A4 will be ignored for the purpose of calculating club face angle at impact.

As can be seen from this explanation, and from further explanation hereinafter, sensors A1–A5 and sensors B1–B5 generate signals which may be utilized for more than one club head or ball flight characteristic detection circuit. For example, sensor B3 is not only utilized for face angle detection in the triangular sensor configuration B3, A4, B5, but it is also utilized in the face angle detection triangular configuration of sensors B1, A2, B3. In addition, as will be explained hereinafter, sensor B3 is also utilized in height detection for detecting the height of the club head above playing surface 11.

The height of club head 16 above playing surface 11 is determined by a pair of these sensors which are spaced longitudinally with the club head path 17, and have their paths of directional sensitivity crossing each other in a vertical plane lying in the longitudinal direction of path 17. A better understanding of the height detectors may be visualized by viewing both FIG. 1 and FIG. 5.

A plurality of such sensor pairs are provided in the event that the club head 16 is not swinging correctly on path 17. The first sensor pair to be activated dominates all of the other sensor pairs.

Figure 5:
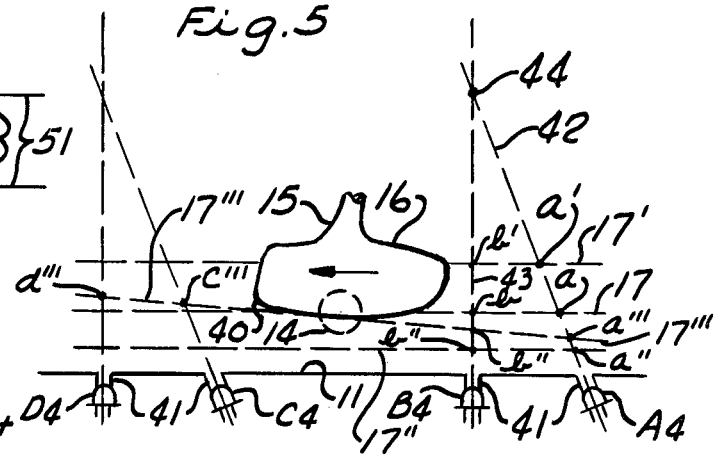
FIG. 5 is a diagrammatic view in front elevation illustrating the preferred club head height detection positioning of height sensor.

These sets of sensor pairs are as follows: pair A1 B1, pair A2 B2, pair A3 B3, pair A4 B4, and pair A5 B5. The cross section of the diagrammatic view of FIG. 5 illustrates only pair A4 B4 for simplification of explanation. Each one of these sensor pairs is provided with a light tunnel shield as indicated at 41 to provide light directional sensitivity for sensors A1–A5 and B1–B5 such that the paths of detectional sensitivity of each pair cross each other in the longitudinal direction as illustrated in FIG. 5. In other words, the sight path of detection for detector A4 in FIG. 5 is indicated by the dashed line 42 and the line of sight detection for detector B4 is indicated by the dashed line 43. These sight lines cross or intersect as indicated at 44.

Thus, as further viewing FIG. 5, if club head 16 is swinging properly on the normal path direction 17, the leading edge 40 will cut sight path 42 at point a and will thereafter cut sight path 43 at point b. The distance between a and b is proportional to the height of club head 16 above playing surface 11.

However, if club head 16 is incorrectly swung at a higher level above playing surface 11 as indicated by path 17', the leading edge 40 of club head 16 will cut sight line 42 at a' and sight line 43 at b'. Thus, the distance between points a' and b' is shorter than the distance between points a and b, and a precise measurement of this time correctly indicates the exact height of club head 16 above playing surface 11.

As a further example, if club head 16 is swung too close to playing surface 11 such as along path direction 17'', then leading edge 40 of club head 16 will engage sight line 42 at point a'' and will thereafter engage sight line 43 at point b''. Thus, the measured distance between points a'' and b'' is longer than that of the normal path distance a b and is directly proportional to the height of club head 16 above playing surface 11 and a signal will indicate that the club head is too low.

Figure 8:
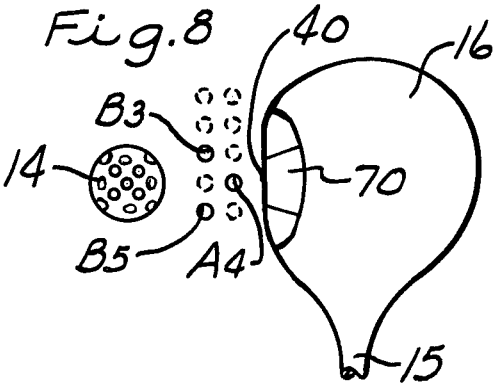
FIG. 8 is a diagrammatic plan view illustrating sensor positioning for the detection of club head face angle at impact.

Also, because this time measurement between points a and b will vary with the velocity of club head 16 for each different or individual swing, actual velocity correction must be made for this detection. This is normally done by taking the actual velocity detection reading for the club head and injecting it for comparison into the detecting circuit for the height detectors. Another way that this may be accomplished is by the use of a third sensor element for comparison detecting such as was accomplished for face angle detection as illustrated in FIG. 8.

Thus, in all, there are five height detector pairs in front of ball image 14, or to the right of ball image 14 as seen in FIG. 1. The circuitry of the device of the present invention selects the signal from the pair which gives the lowest height reading or the longest time a b.

A second set of height detection sensor pairs is provided behind the ball image 14 or to the left thereof as viewed in FIG. 1. These height detector pairs are C1 D1, C2 D2, C3 D3, C4 D4, and C5 D5. These height detector pairs operate in exactly the same manner as was explained with the height detector pairs in front on the ball or ball image 14. With a second set of height detector pairs as illustrated here, the apparatus of the present invention can readily determine whether the club head 16 is rising or descending at the time of impact with ball or ball image 14.

For example, referring to FIG. 5, if club head 16 is swinging along arcuate path 17''', the club head 16 is rising at the time of impact, and the apparatus will quickly detect this and give a reading accordingly as the time between points a''' and b''' will be significantly longer than the time between break points c''' and d''' for directional sensors C4 and D4.

All of the sensors, including horizontal position sensors H1 and H2, are phototransistors or incorporate phototransistors.

Turning next to FIG. 3, this Figure illustrates one embodiment of circuitry for the apparatus of the present invention in block and schematic diagram form. Here again, the display meters 22–28 of FIG. 2 are diagrammatically illustrated at the right-hand side of the Figure. Also, all of the sensors shown on FIG. 1 are diagrammatically illustrated on the left-hand side of FIG. 3. It should be noted that some of the sensors at the left-hand side of the Figure are duplicated or indicated with the same sensor identification. This is because, as previously explained, some of the sensors perform more than one detection function.

Before explaining the circuitry in more detail, it should be understood that the circuitry in and of itself is considered to be conventional, and in addition, many circuitry variations can be employed to perform the same functions. The novelty of the present invention resides in the means or manner in which the swing characteristics of the club head 16 are detected or sensed, as opposed to the particular circuitry that is utilized to interpret the sensor signals.

Because the specifics of the electronics are not the crux of the present invention, the electronic circuitry will not be explained in detail, but rather will be explained broadly in terms of function, as those skilled in the electronics art will readily understand how each specific circuit operates.

Referring first to the switch on or arming sensors S1 and S2 which activate the entire circuitry for detecting a golf swing, sensors S1 and S2 merely sense the velocity of club head 16 and switch on circuit 50 merely detects velocity and when the velocity is beyond a predetermined minimum limit, it permits B+ and B− supply and bias voltages to be immediately supplied to all the remaining circuitry for activation or arming through conductor 51.

Figure 4:
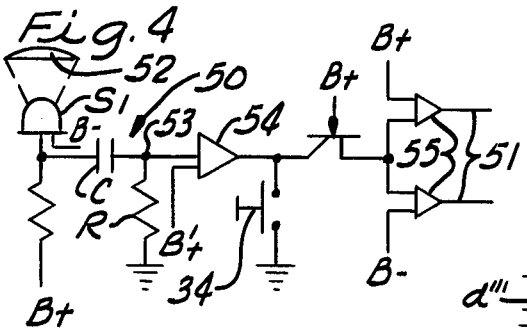
FIG. 4 is a schematic diagram illustrating one example of the switch on or activating circuit in FIG. 3.

In actuality, it is not necessary to have two sesnors S1 and S2 in order to sense velocity. In fact, only one sensor need be utilized. A schematic illustration of such a circuit is illustrated in FIG. 4.

In this schematic illustration, a collector lens 52 is positioned above sensor or phototransistor S1 and this lens focuses or concentrates the light from a light source onto sensor S1. This circuit is self-zeroing, and under normal conditions where bright light is supplied to sensor S1, input 53 of op amp 54 is zero as phototransistor S1 has a low resistance and the B+ and B− voltages are zeroed out. When the golf club head swings over top of lens 52 and cuts off the light source or dims the light source, the resistance of phototransistor S1 becomes high and B+ is supplied to the input 53 of op amp 54. However, op amp 54 is also supplied with B'+ supply voltage, and the pulse voltage applied to input 53 must be at least equal to the B'+ bias before op amp 54 has any output. The RC circuit in combination with phototransistor S1 provides a pulse with a peak voltage equal to or greater than B'+ at terminal 53 when the golf club head passes over lens 52 at a very fast rate when ball contact is intended, and produces a lower pulse peak voltage when the velocity of the club head is slower when passing over lens 52, such as when the player is making a backswing or a ball approach "waggle".

When the pulse voltage 53 is equal to or higher than B'+, op amp 54 supplies an output voltage and current and in this manner, a predetermined velocity limit of the swinging club head is detected. An output from the op amp triggers the gate of the SCR and this in turn activates op amp or power transistors 55 and thereby supplies B+ and B− supply and bias voltages to the remainder of the circuitry to activate the same for detection.

Once a practice swing has been made and meters 22–28 have made their indications, they will hold these indications until the apparatus is reset for another practice swing. The apparatus is reset by the player merely activating switch 34 with the head of his golf club as illustrated in FIG. 1. Reset switch 34 is also illustrated in FIG. 4 and merely grounds out the gate of the SCR to turn it off and stop the supply of B+ and B− to the remainder of the circuitry, thereby resetting the entire apparatus for another practice swing.

Figure 6:
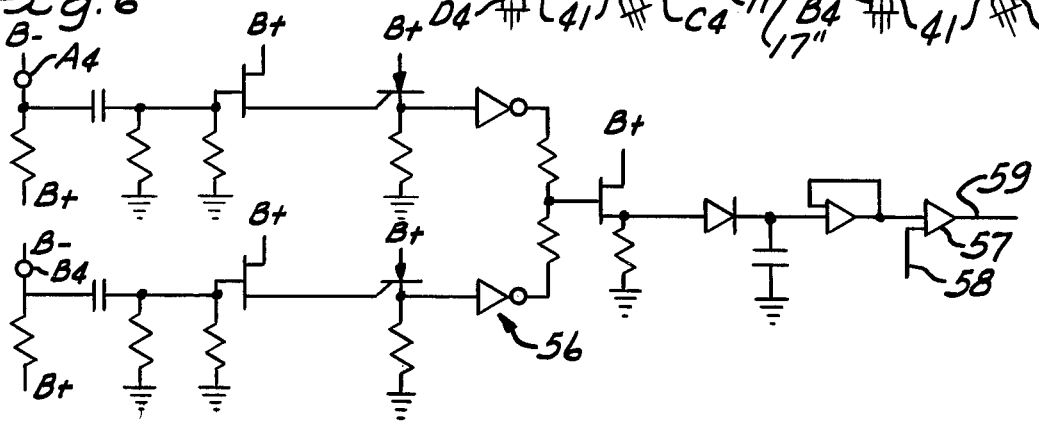
FIG. 6 is a schematic diagram illustrating one example of the electronic circuitry employed for club head height detection in FIG. 3 and further in accordance with the teachings of FIG. 5.

Referring further to FIG. 3, there are ten height detecting circuits 56, one for each height detecting sensor pair as previously explained. An example of this circuitry is schematically illustrated in FIG. 6.

This is a self-zeroing circuit in order to compensate for different brightnesses of light sources. In fact, all of the sensor circuits are self-zeroing. As the club head passes over phototransistor A4 and then subsequently over phototransistor B4, for example, and the pulse generated from sensor A4 is inverted and is compared with the pulse generated from sensor B4 to render a resultant pulse proportional to the time when golf club head 16 cuts the light source to sensor A4 and subsequently cuts the light source for sensor B4, thereby measuring the distance a–b of FIG. 5.

Each golf club practice swing will be at a different velocity, therefore the output signal of this height detector must be corrected to the actual velocity of the club head. This is accomplished by op amp 57, which compares the output of the height discriminating circuit 56 with the actual velocity pulse which is sent from the velocity detector (to be hereinafter described) at input 58 and the resultant velocity corrected height signal for each sensor pair is fed out through conductors 59 to the lowest height detection circuit 60. There are two of these lowest height detection circuits as shown in FIG. 3, and the output of height detection circuits 56 which relate to sensors A1–A5 and B–5 are fed to one lowest height detection circuit 60 and the output for sensors C1–C5 and D1–D5 are fed to the other lowest height detection circuit 60. These lowest height detection circuits 60 respectively detect the lowest height of the club head detected by the sensors in front of the ball and the lowest height of the club head above the playing surface detected by the sensors following or behind the ball. Their outputs 61 and 62 respectively are then fed to the input of club rising or descending detection circuit 63 and club height detection circuit 64. Club rising or descending detection circuit 63 is an op amp which compares the input signal and has its output 65 connected to club rising or descending meter 28. A zero input will indicate that the club is neither rising nor descending.

The output 66 from club height detector 64 is fed into the servo-electronics circuit 67. This is a servo-control and motor circuit, such as commonly utilized for radio controlled model airplanes, and this circuit responds to the club height signal from circuit 64 and in addition also responds to a signal which indicates the club position at the time of impact in the horizontal plane (as will be described hereinafter) to operate the servo-motor accordingly and thereby position club head image 16' in meter 22 in proper relation to ball image 14' to indicate the exact location of contact between the ball and club head at impact.

Figure 10:
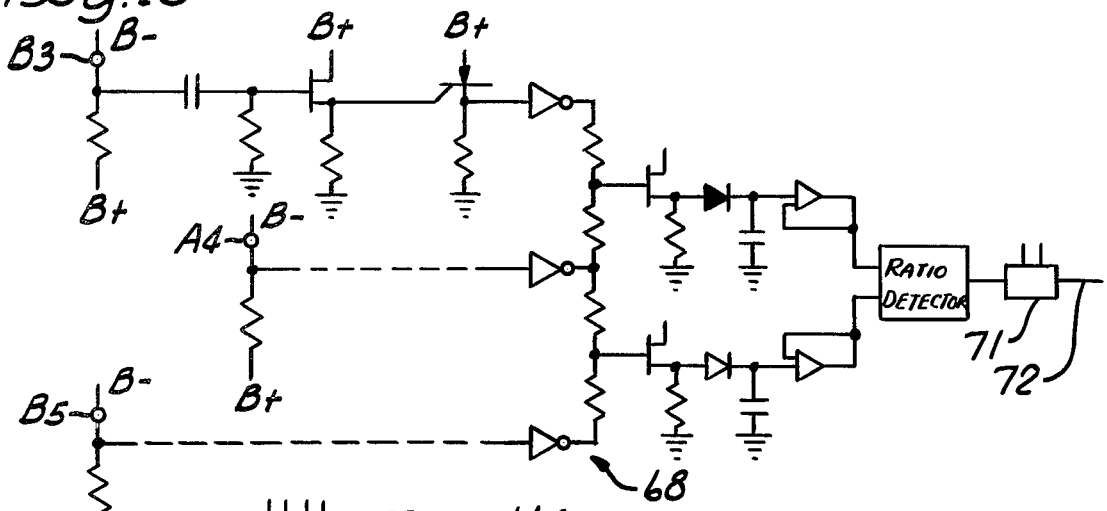
FIG. 10 is an electronic schematic diagram illustrating one possible detection circuit to be utilized in the schematic of FIG. 3 for the detection of face angle in accordance with the teachings of FIGS. 8 and 9.

The three face angle detection circuits 68 are schematically illustrated in FIG. 10. These sensor circuits operate in the same manner as do the height detection circuits 56, with the exception that they are provided with a third sensing circuit as previously explained in relation to FIG. 8. Referring again to FIG. 8 together with FIG. 10, the example is given wherein the three face angle sensors A4 and B5 are employed. Sensor A4 will be the first sensor to have its light source cut by golf club head 16. Thereafter, the light source for sensor B3 or B5 will be cut next, and then vice versa, depending on what the face angle is for club head 16. The pulse from sensor A4 is inverted and compared to the pulse sensors B3 and B5 in the same manner as done with the height detection circuits. The time ratios of detection between detectors A4 and B3 and detectors or sensors A4 and A5 are discriminated by the ratio detector and the corresponding output signal of the circuit 68 is proportional to a plus or minus face angle (faced in or faced out) of club head from 70 in relation to the ball 14 and normal path of direction at impact.

Each of these circuits 68 is provided with a relay 71 at its output, and the first triangular configuration of sensors to be activated correspondingly first energizes its respective relay 71 in its detection circuit and excludes detection by any other face angle triangularly positioned sensor set and the output of the first detected face angle sensing is fed in the form of a pulse signal on output line 72 to the input of shaft rotation circuit 73, ball direction circuit 74 and ball spin circuit 75. These three latter-mentioned circuits also require input of electrical information in regard to the lateral direction of the club head in its swing and the horizontal position of the club head at the time of ball impact.

Figure 12:
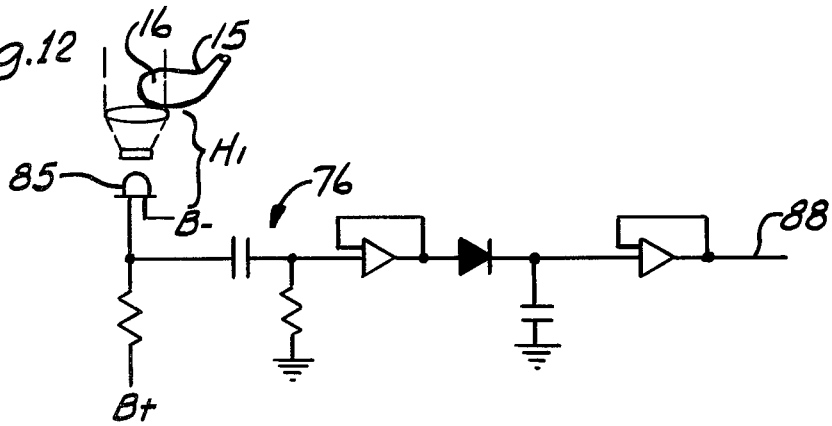
FIG. 12 is a schematic diagram illustrating one example of electronic circuitry employed in the electronics of FIG. 3 for the detection of club head lateral position in accordance with the teachings of FIGS. 11*a*–11*c*.

The club horizontal position, as previously explained, is read by continuous strip sensors H1 and H2 and interpreted by club horizontal position detection circuits 76 respectively. The electronic schematic diagram for these circuits is illustrated in FIG. 12. The novel specifics of the continuous horizontal strip sensors are also illustrated diagrammatically in FIGS. **11*a*–11*c***.

Referring to these Figures and also to FIG. 1, the horizontal position sensor H1 is comprised of a lens 80 which is positioned and secured in playing surface 11 or immediately thereunder such that light is exposed to lens 80 through a corresponding open slot 81 in playing surface 11. As can be seen from the Figures, lens 80 is a long or elongated continuous strip. This lens focuses light from the light source to a focal point 82 on the surface of the light diffuser 83 via light prism 84. The focusing of the light is indicated by the dashed outline in FIGS. **11*a*–11*b*. Prism 84, of course, serves to bend the vertical light waves coming through lens 80 at a right angle so that the entire unit may be housed within the platform 10**.

It is not necessary to use the combination of lens 80 and prism 84 to accomplish this focusing of the light source down to focal point 82 on light diffuser 83. For example, any other suitable means may be employed. As one example, lens 80 may be eliminated and prism 84 may also be eliminated and in substitution thereof, an elongated curved mirror may be placed at a 45° angle below slot 81 to focus the light entering slot 81.

Light diffuser 83 in this instance merely consists of a small piece of frosted glass. Phototransistor 85 takes its light reading in turn from light diffuser 83 instead of directly from light focused from lens 80. Light diffuser 83 is positioned so that it is always within the angle of even sensitivity, or in the sensitive area of the phototransistor as indicated by the dashed outline 86. Thus, should the focal point 82 change its position with regard to light diffuser 83 as, for example, due to flexures or warping in the playing surface 11, an accurate reading will still be obtained, because no matter where focal position 82 changes with regard to its location on the surface of light diffuser 83, diffuser 83 will diffuse the light and the phototransistor takes a full reading from the diffuser thereby providing an accurate reading of the exact amount of light which is occluded from passing through slot 81 and lens 80 due to the passing thereover of golf club head 16.

To the contrary, if the light passing through lens 80 were focused directly onto phototransistor 85, it would be extremely difficult to insure that it would stay focused on the phototransistor, and in the event of warping etc. of the playing surface 11 and other parts within the device, the focal point would readily move off of the phototransistor, thereby giving an inaccurate reading.

Figure 11B:
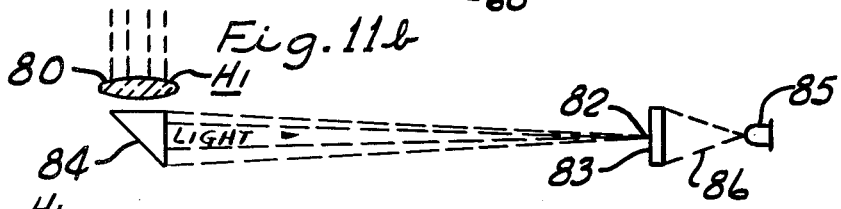
FIG. 11*b* is a diagrammatic view in side elevation of the sensor mechanism illustrated in FIG. 11*a*.
Figure 11A:
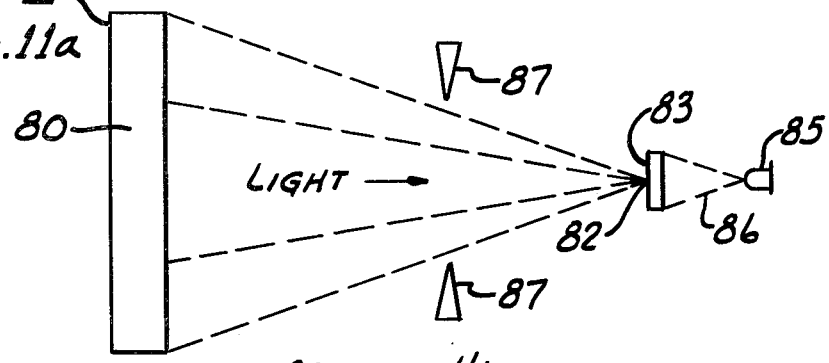
FIG. 11*a* is a diagrammatic plan view of the continuous strip sensors for detecting club head lateral position for employment in the circuitry of FIG. 3.
Figure 11C:
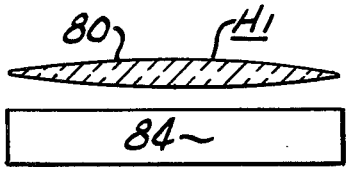
FIG. 11*c* is a diagrammatic view in front elevation of the continuous strip club head lateral position sensor illustrated in FIGS. 11*a* and 11*b*.

As seen in FIG. 11*a*, light stops 87 are provided to precisely limit the amount of light focused onto diffuser 83 to a set or predetermined maximum.

The horizontal position sensors of the prior art consisted of a series of independent spaced phototransistors or photoelectric cells which limited the accuracy of the horizontal position reading of the swinging golf club head, as obviously such a series of sensors cannot accurately sense the exact position of the club head due to the spacing between sensors. To the contrary, the horizontal position sensor of the present invention is a continuous light sensing strip and can extremely accurately locate the horizontal position of the club head as it passes over slot 81 as the amount of light occluded from the passage of the club head thereover will be exactly reflected by the amount of light exposed to phototransistor 85 from light diffuser 83.

A second horizontal position sensor H2 is also provided on the device on the trailing side of ball 14 as shown in FIG. 1 so that the horizontal position of the club head 16 may be determined before and after impact with the ball, thereby providing an exact electrical indication as to whether the club head is swinging on the normal path of direction or is swinging out or in as it makes impact with the ball or ball image 14. Since sensors H1 and H2 are also longitudinally spaced in relation to the normal path of swing or direction 17 of head 16, signals from these sensors are also employed to detect the velocity of the club head 16.

The circuitry of circuit 76 is also self-zeroing and provides an outward signal proportional to the amount of light occluded as the golf club head 16 passes over the sensors H1 and H2. The outputs 88 of both of these horizontal position sensing circuits 76 are respectively fed to the input of a lateral club direction circuit 90, a club horizontal position at ball impact circuit 91 and a speed or velocity circuit 92. Speed circuit 92 merely determines the time relation from when the club head 16 passes over slot 81 to the time when it subsequently passes over slot 89 for sensor 82. The output of speed or velocity detecting circuit 92 then is fed via conductor 93 directly to club head velocity or ball velocity meter 27 for indication.

Lateral club direction circuit 90 compares the amount of light occluded by the club head when its passes over slot 81 with the amount of light occluded as the club head 16 subsequently passes over slot 89, thereby giving an electrical signal indication of the lateral direction of the club head as it is passing through contact with the ball 14. Club horizontal position circuit 91 makes a similar comparison and indicates the exact position horizontally of the club face 70 at the point of impact with the ball, and this signal is fed directly via conductor 94 to the servo-electronics circuit 67 to adjust the horizontal position of the servo-motor therein in a fashion similar to the vertical positioning of the servo-motor of the signal fed through conductor 66 from the height detectors. From these two readings, the servo-electronics circuit can actually position the servo-motor and in turn the golf club head image on its meter as indicated at 16' to show exactly where impact was made or imaginary impact was made, between the club head face and the ball or ball image 14'.

The output of the lateral club direction circuit 90 is fed directly via conductor 95 to the club lateral motion meter 24 to give a direct indication as to whether the club was swinging in or swinging out as it passed through impact with the ball, in relation to the normal path or correct path of direction 17.

As previously explained, the output 95 of the lateral club direction circuit 90 is also fed directly to the shaft rotation circuit 73 together with the output 72 of the face angle detectors to the input of the shaft rotation circuit 73 which compares the face angle signal to the lateral direction of the club to electronically indicate the existence of golf club shaft rotation which is indicated by meter 23 via conductor 96.

The output of lateral club direction circuit 90 and the output of club horizontal position at ball impact designated 91 are also fed directly to the ball direction circuit 74 and the ball spin circuit 75 together with output 72 from the face angle dectors. By comparing these three signals, ball direction circuit 74 provides an output signal on line 97 which is proportional to the simulated direction that the ball would travel under actual conditions and meter 25 correspondingly indicates whether the ball went to the right or left and the degree to which it went to the right or left.

Likewise, ball spin circuit 75 of similar configuration analyzes and compares the three input signals to determine whether the ball hooked or sliced and the degree to which it hooked or sliced, and this output is fed via conductor 98 to hook-slice meter 26 for indication.

Figure 7:
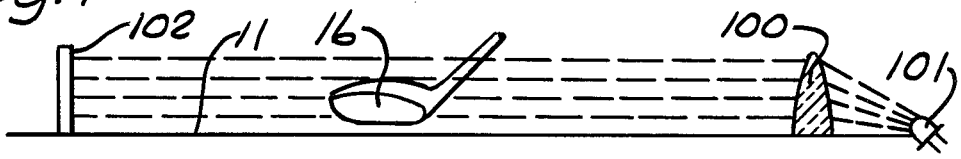
FIG. 7 is a diagrammatic view in side elevation illustrating an alternative embodiment for club head height detection.

FIG. 7 illustrates an alternative height position detector for the swinging club head. However, this detector as illustrated in FIG. 7 is not preferred to the novel height detector already described due to the fact that it requires the positioning of detection elements above the playing surface 11, which exposes them to possible damage.

In this circuit, element 100 represents a light focusing lens, and in one configuration element 101 represents a light source or light bulb. The light from this light source is directed by lens 100 to cover continuous strip sensor 102. When the golf club head swings through this source of light as indicated in the Figure, a portion of the light fed to sensor 102 is occluded. A detection circuit similar to that used for the horizontal sensors H1 and H2 is enclosed to take a reading of sensor 102 to indicate height of the golf club head 16 above the playing surface 11.

As an alternative, element 102 may represent a strip light source and element 101 may represent a phototransistor. Thus, when the club head swings through the path of light between source 102 and lens 100, a certain amount of light is occluded which is fed to sensor 101 in proportion to the height of club head 16 above the playing surface 11, and conventional circuitry as previously described may be utilized to interpret readings from phototransistor 101.

Figure 9:
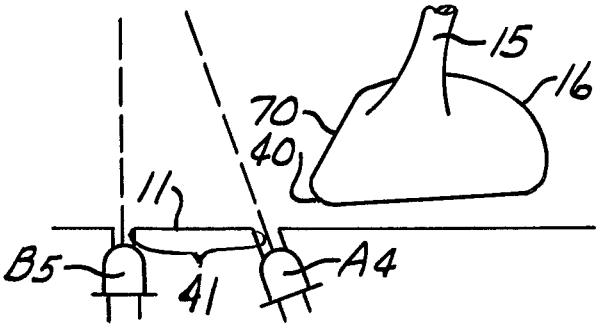
FIG. 9 is a diagrammatic view in front elevation of the representation shown in FIG. 8.

Also, it should be mentioned in relation to FIG. 9, which relates to the detection of face angle, that the light directional sensitivity of sensors A4 and B5, and for that matter also B3 as seen in FIG. 8, in such that their light sensing angle is to the left as opposed to the angle which is to the right for the face 70 of golf club head 16. This is because the sensors A4 and A5 are also utilized for the purpose of detecting golf club height. In actuality, separate sensors can be employed for sensing face angle, and if so done, it is preferable that the angle of the light sensing direction for the triangularly spaced sensors be to the right at the same angle of club face 70. The reason for this is that the leading edge 40 of the golf club head 16 tends to give a shadow from overhead which is on a curved line thereby giving readings which may be a little inaccurate. By slanting the sensing direction of the sensors to be at the same angle as face angle 70, the shadow then seen by the sensors will be a straight line or approximately a straight line to give more accurate readings.

I claim:

1. In golf practice apparatus which includes structure defining a normal path direction and a normal point of impact of a golf club head during a practice swing, mechanism for representing the lateral or vertical position of the swinging club head, comprising in combination, a light sensitive sensor, a continuous strip sensor positioned laterally of the club head path for developing a signal proportional to the portion of length thereof passed over by a swinging club head, said continuous strip sensor including a light receiving strip means to focus light received from the entire strip to said light sensitive sensor, and output means for utilizing the output signal from the continuous strip sensor as a representation of the lateral or vertical position of the club head.

2. Mechanism as defined in claim 1, wherein said means to focus includes a light diffuser positioned to receive light focused from the strip, said light sensitive sensor positioned to sense light from said diffuser.

3. Mechanism as defined in claim 1, and including two mechanisms as defined for representing the lateral position of the swinging club head, the light receiving strips of the respective mechanisms being relatively spaced longitudinally of the club head path, electronic circuit means responsive to the output signal of both said mechanisms and acting to produce a final signal that represents the direction of lateral movement of the club head between the light receiving strips of the respective mechanisms.

4. In golf practice apparatus which includes structure defining a normal path direction and a normal point of impact of a golf club head during a practice swing, mechanism for representing the height position of the swinging club head, comprising in combination, two directional-sensitive sensors spaced longitudinally with the club head path and having their paths of directional sensitivity crossing in the longitudinal direction, the sensors for developing signals responsive to the passage of the club head leading edge through their respective paths of directional sensitivity at respective longitudinally spaced points of the club head path, time-discriminating circuit means receiving the signals and responsive to the mutual time relation in which the signals are received and thereby producing an output signal proportional to the height of the club head within the normal path of direction, and including velocity correction circuit means to correct the output signal for the velocity of the club head, and output display means for utilizing the output signal from the circuit means for representing vertical height of the club head within the normal path direction.

5. Mechanism as defined in claim 4, and including two mechanisms as defined for representing the height of the swinging club head, the sensors of the respective mechanisms being relatively spaced longitudinally of the club head path, electronic circuit means responsive to the output signal of both said mechanisms and acting to produce a final signal that represents the direction of vertical movement of the club head between the sensors of the respective mechanisms.

6. Mechanism as defined in claim 4, wherein said velocity correction circuit means includes a third sensor spaced from said two sensors in the club head normal path and time-discriminating circuit means receiving output signals from all three sensors and responsive to the mutual time relations in which the signals from said two sensors are received relative to the third sensor to provide said velocity correction.

7. In a golf practice apparatus which includes structure representing a golf ball and defining a normal path of a golf club head during a practice swing including mechanism for detecting and displaying swing characteristics of the swinging club head, mechanism for disabling the display of the swing characteristics during ball addressing movements of the club head while addressing the ball prior to a practice swing, comprising in combination, reset circuit means to de-activate the display of club head swing characteristics in the normal swing path, and velocity limit detection circuit means responsive to a predetermined practice swing minimum velocity limit of the club head in the normal path to activate the display of club head swing characteristics in the normal swing path.

* * * * *